US006869385B2

(12) United States Patent
Kimura et al.

(10) Patent No.: US 6,869,385 B2
(45) Date of Patent: Mar. 22, 2005

(54) OIL-COATING ROLLER

(75) Inventors: Kohichi Kimura, Minato-ku (JP); Tatsuo Takagi, Hamamatsu (JP); Yousuke Suganuma, Hamamatsu (JP); Isami Abe, Hamamatsu (JP)

(73) Assignee: Nichias Corporation, Tokyo (JP)

( * ) Notice: Subject to any disclaimer, the term of this patent is extended or adjusted under 35 U.S.C. 154(b) by 0 days.

(21) Appl. No.: 10/390,598

(22) Filed: Mar. 19, 2003

(65) Prior Publication Data

US 2003/0186796 A1 Oct. 2, 2003

(30) Foreign Application Priority Data

Mar. 29, 2002 (JP) ..... 2002-094663

(51) Int. Cl.[7] ..... B25F 5/02
(52) U.S. Cl. ..... 492/51; 492/56
(58) Field of Search ..... 492/56, 54, 59, 492/51; 399/325; 118/60, 260, 264, 266; 442/320, 324; 428/308.4, 317.7

(56) References Cited

U.S. PATENT DOCUMENTS 5,674,020 A * 10/1997 Kimura et al. ..... 401/197
5,800,745 A * 9/1998 Miyahara et al. ..... 264/13
5,876,640 A * 3/1999 Miyahara et al. ..... 264/42
5,902,653 A * 5/1999 Miyahara et al. ..... 428/34.1
6,006,063 A * 12/1999 Shimizu et al. ..... 399/325
6,336,972 B1 * 1/2002 Kimura et al. ..... 118/270
6,480,694 B1 * 11/2002 Kimura et al. ..... 399/325
6,519,440 B2 * 2/2003 Kimura et al. ..... 399/325
6,579,813 B1 * 6/2003 Kimura et al. ..... 442/320
6,666,939 B2 * 12/2003 Kimura et al. ..... 156/93

FOREIGN PATENT DOCUMENTS

JP 10171288 * 6/1998
JP 11344891 * 12/1999
JP 2000056610 * 2/2000

* cited by examiner

*Primary Examiner*—Irene Cuda Rosenbaum
(74) *Attorney, Agent, or Firm*—Wenderoth, Lind & Ponack, L.L.C.

(57) ABSTRACT

An oil-coating roller constituted mainly of an oil-retaining layer around a central core and an oil-coating control layer surrounding the oil-retaining layer is provided which does not require a sealing treatment for prevention of oil leakage from the roller end face, and has a long service life. The oil-retaining layer is formed by winding in layers a non-woven fabric which exhibits an oil-sucking height of not less than 60 mm and has an oil permeability of 40 g/cm$^2$/hr.

8 Claims, 2 Drawing Sheets

OIL-COATING ROLLER

BACKGROUND OF THE INVENTION

1. Field of the Invention

The present invention relates to an oil-coating roller for applying a releasing oil to a surface of a fixing roller of electrostatic copying machines, electronic cameras, printers, and so forth.

2. Background Art

Conventionally, in electrostatic copying machines, electronic cameras, printers, or the like, the fixing roller of the fixing unit is kept coated with a releasing oil by an oil-applying member such as an oil-coating roller for prevention of toner sticking or paper sheet winding, or prevention of the abrasion of the heating roller. The oil-coating roller is usually constituted mainly of a central core, an oil-retaining layer, and an oil-coating control layer constituted of a porous PTFE film or the like, as necessary. The oil is impregnated and retained in the oil-retaining layer, and is transferred onto the surface of the fixing roller at a required rate.

The oil-coating rollers are used usually as disposable consumables, and are disposed after the oil impregnated in the oil-retaining layer has been used up or the oil has come not to exude at a required rate out of the surface of the porous layer. Therefore, the effective service life of the oil-coating roller is evaluated by the quantity of the oil which can exude out from the oil-retaining layer at a required rate, namely the available oil quantity. In other words, the larger the oil retaining quantity and the smaller the unavailable remaining oil quantity, the longer is the service life of the oil-coating roller.

However, in the case where the oil is impregnated in a larger quantity, the oil tends to leak out from the end face of the oil-retaining layer, although the oil-coating control layer outside the oil-retaining layer prevents the oil leakage from the roller surface. Therefore, in most instances, the roller end faces should be treated for sealing to retard or prevent the oil leakage. This is disadvantageous economically for use as disposable consumables. On the other hand, the decrease of the oil impregnation amount decreases the aforementioned available oil amount to shorten the effective service life.

The oil-retaining layers are known in which sheets of rock wool or sheets of mixed fiber such as aramid or polyester wound in layers, for example, as shown in Japanese Patent Application Laid-Open Nos. 6-348166 and 9-185285. The oil-retaining layer made from such a material has high oil-retaining power, being less liable to cause oil leakage in vertical placement or in practical use. However, such an oil-retaining layer has a low oil impregnation capacity owing to less porosity, and the oil exudation rate can decrease below the required rate even with the oil remaining therein, resulting in a small available oil quantity and a low oil availability ratio, disadvantageously.

Japanese Patent Application Laid-Open Nos. 4-139477 and 2001-318553 discloses an oil-retaining layer constituted of a silicone rubber or a melamine resin sponge. The oil-retaining layer made of such a material is capable of impregnating a larger quantity of oil and exhibits a higher oil availability and a higher available oil ratio owing to high porosity of the material. However, the oil-coating roller employing such a material has a low oil-retaining power to cause oil leakage in vertical placement state or in practical use. Therefore, such a type of oil roller requires a countermeasure against the oil leakage such as sealing at the both end faces for retardation or prevention of the oil leakage. This results in a higher cost of the oil-retaining roller.

As described above, the oil-coating roller is not readily obtainable which is free from oil leakage and simultaneously achieves a large available oil quantity and a high oil availability ratio. The present invention is made to solve the above problem. The present invention intends to provide an oil-coating roller constituted mainly of an oil-retaining layer around a central core, and an oil-coating control layer surrounding the oil-retaining layer, the roller not requiring treatment for sealing the and faces against oil leakage and having a long service life.

OBJECT AND SUMMARY OF THE INVENTION

After comprehensive investigation for solving the above problems, the inventors of the present invention found that the oil retention quantity in the vertical placement state depends greatly on the oil sucking height of the nonwoven fabric constituting the oil-retaining layer, and the available oil quantity depends greatly on the oil permeability of the nonwoven fabric. Based on the findings, the present invention has been completed.

The present invention relates to an oil-coating roller comprises a control core, an oil-retaining layer around the central core, and an oil-coating control layer surrounding the oil-retaining layer, wherein the oil-retaining layer is formed by winding, preferably in layers, a nonwoven fabric which exhibits an oil-sucking height of not less than 60 and has an oil permeability of not less than 40 $g/cm^2/hr$.

DESCRIPTION OF THE INVENTION

The present invention is described below in detail.

The oil-coating roller of the present invention is mainly constituted of an oil-retaining layer around a central core, and an oil-coating control layer surrounding the oil-retaining layer.

The aforementioned oil is applied onto the surface of a fixing roller of a fixing unit by the oil-coating roller for prevention of toner sticking or paper sheet winding onto the fixing roller surface, or prevention of the abrasion of the heating roller in electrostatic copying machines, electronic cameras, printers, and so forth.

The oil is called a "releasing oil". Silicone oils are suitably used in view of their releasability, heat resistance, and other properties. Various viscosities of oils are used depending on the application conditions. Usually the oil used has a viscosity of not higher than 30,000 cSt since the oil of a higher viscosity is less fluid for the oil application. The oil includes specifically dimethylsilicone oils, amino-modified silicone oils, and fluorine-modified silicone oils, but is not specially limited thereto.

The central core may be constructed from known material in a conventional shape and dimension. The material includes aluminum, iron, stainless steel, and brass. Aluminum is suitably used in view of the cost and the workability. The diameter of the central core is decided depending on the usage in the range, for example, of about 5–20 mm.

The aforementioned oil-retaining layer retains the impregnated oil to be applied by the oil-coating roller. The oil impregnated into this layer exudes out through the oil application-controlling layer to be transferred onto a fixing roller or the like. A longer service life of the oil-coating roller results from a larger amount of the oil which can exude through the oil-coating control layer for transfer onto the fixing roller or the like means.

For the longer service life of the oil-coating roller as mentioned above in the present invention, the oil-retaining layer is constituted of a specified nonwoven fabric wound in layers, the nonwoven fabric exhibiting the oil-sucking height of not less than 60 mm and having the oil permeability of 40 g/cm$^2$/hr. The nonwoven fabric has a porosity, preferably, of not less than 70% for a larger amount of impregnation of the oil. Incidentally, the oil-sucking height and the oil permeability depend on the width of the pores, namely the thickness of the capillaries, formed in the nonwoven fabric, and these properties vary in an inverse relation. Both properties have lower limits. The upper limits thereof depend on the combination of the silicone oil and the nonwoven material. Therefore, both properties cannot be increased infinitely.

The aforementioned nonwoven fabric is not limited specially and is exemplified by a nonwoven fabric formed by heat-bonding of polyester long filaments, specifically VOLANS, and ECULE (trade names, Toyo Boseki K.K.).

The nonwoven fabric is wound around the central core with a winding tension of conventional conditions. The winding tension is usually in the range of about 1–100 N/m, preferably 5–50 N/m, for utilizing the properties of the nonwoven fabric.

The oil-sucking height mentioned above means the height of sucking of oil by capillarity. In the present invention, the sucking height is measured according to the method for testing water absorbency described in JIS P-8141 except that a silicone oil of 100 cSt is used in place of water.

The oil permeability mentioned above means the quantity of a silicone oil of a viscosity of 100 cSt permeating through a unit area (cm$^2$) for a unit time (hr) under a pressure of 1 kPa, showing the oil permeability of the nonwoven fabric. The porosity mentioned above is calculated from the pore volume of the nonwoven fabric measured with Air-Comparison Type Specific Gravity Meter Model 1000 (manufactured by Tokyo Science K.K.).

The oil-retaining layer formed from the nonwoven fabric as the material having the above properties has an oil retention capacity of not less than 0.22 g/cm$^3$, and gives an oil availability ratio of not less than 70% of the retained oil, being suitable for the oil-retaining layer of the oil-coating roller.

The oil-coating control layer is provided for controlling exudation of the retained oil from the oil-retaining layer preferably through an oil-transfer layer provided between the oil-controlling layer and the oil-retaining layer gradually at a suitable fine rate.

The oil-coating control layer is usually a porous film. Such a film can be formed by applying a mixture of a silicone or a silicone rubber and a silicone oil or a component vaporizable by heating around the oil-transfer layer, and heat-treating the applied mixture to form fine pores. For use for an oil-coating roller of a toner fixing unit, suitable are polytetrafluoroethylene films (hereinafter referred to as "porous PTFE film").

The above porous film has preferably a thickness of 15–130 $\mu$m having many pores of average diameter of 0.1–2 $\mu$m, a surface roughness Ra of 0.5–2.0 $\mu$m, a porosity of 60–90%, and an air permeability of 3–1500 (sec/100 cc) in terms of a Gurley number measured by a B-Type Gurley Densometer.

The oil-transfer layer serves to allow the oil to diffuse and penetrate into the oil-coating control layer. The oil-transfer layer may have a multiple layer structure.

The material for the oil-transfer layer includes a porous felt, made of heat-resistant fibers such as aramid fibers. The oil-transfer layer is preferably molded in a shape planer by needle-punching or a like process to have a uniform density throughout the entire plane. The felt layer has a basis weight of 60–1000 g/m$^2$, preferably 170–800 g/m$^2$, and a thickness of 0.5–5.0 mm, preferably 2–3 mm.

The oil-retaining layer, the oil-transfer layer, and application rate-controlling layer are fixed together in lamination by a conventional method. Of the methods, the lamination between the oil-retaining layer and the oil-coating control layer or between the oil-transfer layer and the oil-coating control layer is preferably formed with an adhesive in view of the uniformity of the oil exudation rate.

The bonding by use of the adhesive is not limited, provided that the contact faces are not completely covered with the adhesive. In an example, an adhesive composed mainly of an RTV rubber (room-temperature vulcanizing rubber), LTV rubber (low-temperature vulcanizing rubber), UV vulcanizing rubber, or the like is applied onto one of the faces in dots, in a grid, or in a pear-skin texture, and adhesion is caused locally. In another example, for fine control of the oil exudation, an adhesive composed of a silicone varnish and a silicone oil is applied on the one face or locally or entirely on the both faces, and the silicone varnish is cured.

The oil-coating roller structure prepared as described above, before oil impregnation, is turned out into the oil-coating roller by oil impregnation. The oil impregnation is conducted preferably by injecting the oil under pressure through at least one end face of the oil applying structure by controlling the quantity of the oil impregnated into the oil-retaining layer and the oil-transfer layer. For example, the impregnation by injection is conducted by use of an oil-supplying chucking jig explained below.

The chucking jig is constituted of a tip portion for forming the concave space for injecting the oil through the end face of the oil-coating roller structure into the oil-retaining layer, and a supplying tube portion for supplying the oil to the tip portion. The tip portion has an opening to form the concave of the concave space, and an annular projection to come into fluid-tight pressure contact with the opposite end face of the oil-retaining layer not to cause oil leakage.

The dimension of the periphery of the annular projection is designed to keep a gap from the end of the application rate-controlling layer. In other word, the breadth is adjusted such that, when the tip portion is pressed against the end face, a part of the oil-retaining layer or the oil-transfer layer is left bared. At the supplying tube portion, a connector for connection with a pressurizing apparatus is provided, and an oil supply-controlling valve can be assembled thereto for controlling the oil supply.

In injection and impregnation of the oil by use of the chucking jig through one end face, the other end face where the oil-supplying chucking jig is not brought into contact is preferably closed by pressure contact of an end-face-closing jig to prevent leakage of the oil from the end face. The end-face-closing chucking jig has suitably a constitution similar to that of the oil-supplying chucking jig in which the oil-supplying tube is omitted and the concave space only is held. Naturally the oil-supplying chucking jig with the valve closed is useful therefor.

In the case where the oil is impregnated into the oil-retaining layer with adjustment not to leak out by its self weight as described above, the end face of the oil-coating roller need not be sealed to be liquid-tight. Without the need for the liquid-tight sealing, for example, such simple treatment is sufficient that the breadth of the porous fluororesin film as the application rate-controlling layer may be made larger than the breadth of the roller and the portion of the film protruding from the both ends of the roller is folded and pushed toward the central core.

In this treatment, the fixation of the folded portion by pushing is not limited specially in its fixation method. In an example, a member called a push ring is fitted thereto. The push ring, which is made from a spring plate, is fixed by the function of the spring plate at the center of the plate to the supporting portion of the central core, and pushes and fixes continuously the folded portion of the film at the roller end.

DESCRIPTION OF THE PREFERRED EMBODIMENTS

The present invention is explained below in more detail by reference to drawings without limiting the invention to the examples within the gist of the invention.

EXAMPLE 1

Figure 1:
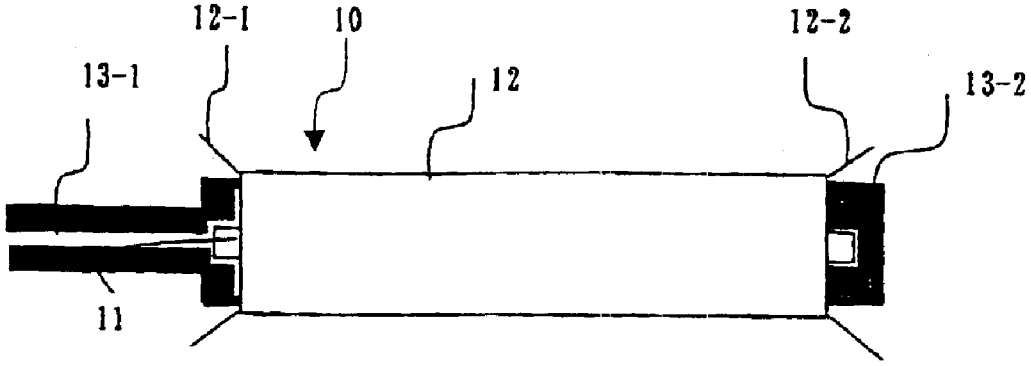
FIG. 1 illustrates a process for supplying an oil by pushing an oil-supplying chucking jig through the end face of an oil-coating roller structure.
Figure 2:
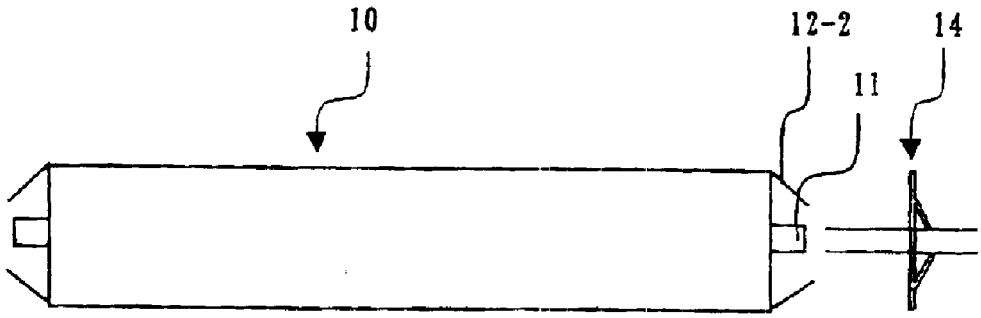
FIG. 2 illustrates a process of simple packing of the end face of the oil-coating roller with an oil impregnated therein.
Figure 3:
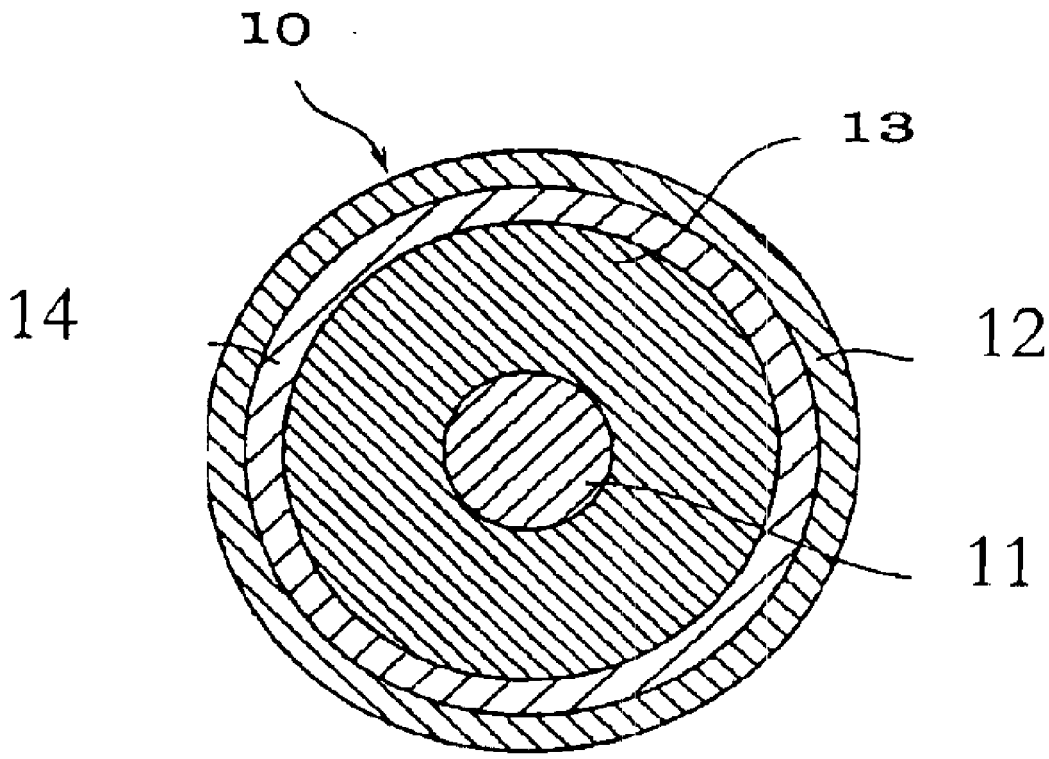
FIG. 3 illustrates a cross-section of the oil-coating roller of the invention, with a oil-retaining layer (13) around a central core (11) and an oil-transfer layer (14) between the oil-retaining layer (13) and the oil-containing control layer (12).

An oil-retaining layer is formed by winding a nonwoven fabric (trade name: ECULE 6501A, Toyo Boseki K.K., made from polyester long-filaments) of 0.3 mm thick and 217 mm wide under a tension of 10 N/m around a central core 11 of 12 mm outside diameter and 223 mm long to obtain the outside diameter of 30.4 mm of the wound layer. Around the oil-retaining layer an oil-transfer layer is formed by winding a unwoven fabric (Nomex felt) composed of aramide fibers with an average diameter of 18 $\mu$m and having a thickness of 2.8 mm and a porosity of 82% to achieve a roller outer diameter of 36 mm in a similar manner as the oil-retaining layer. The above nonwoven fabric was used as the oil-retaining layer and tested for the oil-sucking height, the oil permeability, and the porosity according to the aforementioned methods.

On the surface of the oil-transfer layer, an adhesive prepared by mixing a silicone varnish and a silicone oil in a mass ratio of 50:50 was applied in an amount of 70 g/cm$^2$. Thereon, a polytetrafluoroethylene (PTFE) film 12 of 80 $\mu$m thick and 240 mm wide having an average pore size of 0.2 $\mu$m was placed by adjusting the protruding edge portions at the both ends to be equal in length, and was wound in one layer to obtain an oil-coating roller structure 10.

The obtained oil-coating roller structure 10 was weighed precisely. Then, the tip portion of the aforementioned oil-supplying chucking jig was pushed against one face of the roller with a portion of the periphery of the oil-transfer layer left unpushed. The end-face-closing chucking jig is pushed against the other end face of the roller. A 100-g portion of dimethylsilicone oil KF-96 having viscosity of 100 cSt was fed to the oil-supplying tube, and thereto a pressure of 0.3 kPa was applied by connection with a pressurizing apparatus to inject and impregnate the oil. Thus an oil-coating roller 10 was prepared.

The oil-coating roller was tested for oil leakage by vertical placement. In the test, the roller was kept hung with the one end face directed downward under the conditions of 25° C. and 50% humidity for one day (24 hours) The oil retention in vertical placement was derived by measuring the mass change.

In the oil-coating roller 10 after the test for oil retention test in vertical placement, the protruding edge portions of the porous PTFE film at the both ends were folded toward the central core. The folded film portions were pushed by push rings from the outside to obtain oil-coating roller 10 for practical use. This oil-coating roller 10 was set in a color printer. Color images were printed continuously on A-4-size printing paper sheets in printing lots of 500 sheets. Between the printing operations in lots, the decrease of the mass of the roller was measured for the lot, and the average oil application quantity per sheet was calculated by dividing the mass decrease by the number of the paper sheets.

The printing test was continued until the application quantity decreased to be lower than 1 mg per sheet. At that time, the remaining oil quantity (g) in the oil-coating roller 10 was measured. Therefrom, the available oil quantity (g, and the apparent quantity per unit volume of the oil-retaining layer: g/cm$^3$) used effectively during the test period was calculated. Further, the ratio of the available oil quantity to the retention quantity in the vertical placement test was derived according to the equation below.

Available oil ratio (%)=(Available oil quantity)÷(Retention quantity at vertical placement test)×100

Table 1 shows the oil retention quantity at the vertical placement test, the available oil quantity, the available oil ratio in the above test, together with the principal conditions of the oil-coating roller.

EXAMPLE 2

An oil-coating roller was prepared by winding the oil-retaining layer and impregnating 100 g of oil in the same manner as in Example 1 except that a nonwoven fabric (trade name: VOLANS 4051N, Toyo Boseki K.K., made from polyester long-filaments) of 0.5 mm thick and 217 mm wide was used as the nonwoven for constituting the oil-retaining layer.

The nonwoven fabric used was tested for the oil-sucking height, the oil permeability, and the porosity. The oil-coating roller 10 was tested for the oil retention quantity at vertical placement, the available oil quantity (g, and the apparent quantity per unit volume of the oil-retaining layer: g/cm$^3$), and the available oil ratio, in the same manner as in Example 1. Table 1 shows the obtained results together with the conditions of the oil-coating roller 10.

COMPARATIVE EXAMPLE 1

An oil-coating roller 10 was prepared by winding the oil-retaining layer and impregnating 100 g of oil in the same manner as in Example 1 except that an aramid paper sheet of 0.1 mm thick and 217 mm wide was used as the nonwoven for constituting the oil-retaining layer.

The nonwoven fabric used was tested for the oil-sucking height, the oil permeability, and the porosity. The oil-coating roller 10 was tested for the oil retention quantity at vertical placement, the available oil quantity (g, and the apparent quantity per unit volume of the oil-retaining layer: g/cm$^3$), and the available oil ratio, in the same manner as in Example 1. Table 1 shows the obtained results together with the conditions of the oil-coating roller 10.

COMPARATIVE EXAMPLE 2

An oil-coating roller 10 was prepared by winding the oil-retaining layer and impregnating 100 g of oil in the same manner as in Example 1 except that a pulp paper sheet of 0.1 mm thick and 217 mm wide was used as the nonwoven for constituting the oil-retaining layer.

The nonwoven fabric used was tested for the oil-sucking height, the oil permeability, and the porosity. The oil-coating roller 10 was tested for the oil retention quantity at vertical placement, the available oil quantity (g, and the apparent quantity per unit volume of the oil-retaining layer: g/cm$^3$), and the available oil ratio, in the same manner as in Example 1. Table 1 shows the obtained results together with the conditions of the oil-coating roller 10.

COMPARATIVE EXAMPLE 3

An oil-coating roller 10 was prepared by winding the oil-retaining layer and impregnating 100 g of oil in the same manner as in Example 1 except that a rock wool paper sheet of 0.3 mm thick and 217 mm wide was used as the nonwoven for constituting the oil-retaining layer.

The nonwoven fabric used was tested for the oil-sucking height, the oil permeability, and the porosity. The oil-coating roller 10 was tested for the oil retention quantity at vertical placement, the available oil quantity (g, and the apparent quantity per unit volume of the oil-retaining layer: g/cm$^3$), and the available oil ratio, in the same manner as in Example 1. Table 1 shows the obtained results together with the conditions of the oil-coating roller 10.

COMPARATIVE EXAMPLE 4

An oil-coating roller 10 was prepared by winding the oil-retaining layer and impregnating 100 g of oil in the same manner as in Example 1 except that a tubular shape of porous melamine resin sponge in a shape of a tube having an inside diameter of 12 mm, an outside diameter of 36 mm, and a length of 217 mm was used to cover the central core as the oil-retaining layer.

The sponge used was tested for the oil-sucking height, the oil permeability, and the porosity. The oil-coating roller 10 was tested for the oil retention quantity at vertical placement, the available oil quantity (g, and the quantity per unit volume of the oil-retaining layer: g/cm$^3$); and the available oil ratio, in the same manner as in Example 1. Table 1 shows the obtained results together with the conditions of the oil-coating roller 10.

TABLE 1

| | Example | | Comparative Example | | | |
|---|---|---|---|---|---|---|
| | 1 | 2 | 1 | 2 | 3 | 4 |
| Oil application rate-controlling layer | PTFE porous film | | | | | |
| Oil-retaining layer | Polyester long-filament nonwoven fabric | | Aramide paper | Pulp paper | Rock wool paper | Melamine resin sponge |
| Porosity | 85% | 86% | 45% | 60% | 43% | 90% |
| Oil-sucking height | 82 mm | 65 mm | 95 mm | 115 mm | 83 mm | 8 mm |

TABLE 1-continued

| | Example | | Comparative Example | | | |
|---|---|---|---|---|---|---|
| | 1 | 2 | 1 | 2 | 3 | 4 |
| Oil permeability (g/cm$^2$/hr) | 45.4 | 49 | 1.2 | 10.5 | 0.5 | 52 |
| Injected oil quantity | 100 g | 100 g | 100 g | 100 g | 100 g | 100 g |
| Oil retention in vertical placement (g/cm$^3$) | 85 g<br>0.433 | 79 g<br>0.402 | 92 g<br>0.469 | 98 g<br>0.499 | 88 g<br>0.448 | 55 g<br>0.280 |
| Available oil quantity (g/cm$^3$) | 61 g<br>0.311 | 59 g<br>0.301 | 27 g<br>0.138 | 41 g<br>0.209 | 21 g<br>0.107 | 38 g<br>0.194 |
| Available oil ratio | 71.8% | 74.7% | 29.3% | 41.8% | 23.9% | 69.1% |

As shown in Table 1, among the oil-coating rollers 10 having the oil-retaining layer and the oil-transfer layer of the same dimension and the same volume of Examples 1–2 and Comparative Examples 1–4, the oil-coating rollers 10 of Examples 1–2, in which the used nonwoven fabrics had an oil-sucking height of not less than 60 mm and an oil permeability of 40 g/cm$^2$/hr, achieved a large oil retention quantity at vertical placement test of not more than 0.40 g/cm$^3$ for apparent unit volume; a large available oil quantity of not less than 0.22 g/cm$^3$, in the Examples 0.30 g/cm$^3$ out of the above large oil retention quantity at vertical placement test; and a high available oil ratio of not less than 70%. Thus an oil-coating roller has been provided which has a long service life, produced at a low cost without complicated end face sealing treatment for prevention of oil leakage, and is highly efficient.

In contrast, the oil-coating rollers of Comparative Examples 1–3, although they had a large oil retention quantity at the vertical placement test, had a less available oil quantity in the range where oil leakage is not caused. The oil-coating roller 10 of Comparative Example 4 employing the porous melamine resin sponge, although it had relatively a high available oil ratio, exhibited a small oil retention quantity, resulting in a small amount of the available oil quantity.

The oil-coating roller 10 produced according to the present invention will not cause oil leakage even with impregnation of a large quantity of oil, rendering unnecessary the sealing treatment, and has a long service life owing to a larger available oil ratio out of a large quantity of the impregnated oil. Therefore the present invention is highly valuable industrially.

What is claimed is:

1. An oil-coating roller, comprising a central core, an oil-retaining layer around the central core and an oil-coating control layer surrounding the oil-retaining layer, wherein the oil-retaining layer is formed by winding a nonwoven fabric formed by fusion-bonding of polyester long-filaments which exhibits an oil-sucking height of not less than 60 mm and has an oil permeability of 40 g/cm$^2$/hr.

2. The oil-coating roller according to claim 1, wherein the nonwoven fabric has a porosity of not less than 70%.

3. An oil-coating roller according to claim 2, which further comprises an oil transfer layer provided between the oil-coating control layer and the oil-retaining layer.

4. An oil-coating roller according to claim 1, which further comprises an oil transfer layer provided between the oil-coating control layer and the oil-retaining layer.

5. An oil-coating roller, comprising a central core, an oil-retaining layer around the central core and an oil-coating control layer surrounding the oil-retaining layer, wherein the oil-retaining layer is formed by winding a nonwoven fabric formed by fusion-bonding of polyester long-filaments, and is capable of retaining the oil in an available quantity of not less than 0.22 $g/cm^3$.

6. An oil-coating roller according to claim 5, which further comprises an oil-transfer layer provided between the oil-coating control layer and the oil-retaining layer.

7. An oil-coating roller, comprising a central core, an oil-retaining layer around the central core and an oil-coating control layer surrounding the oil-retaining layer, wherein the oil-retaining layer is formed by winding a nonwoven fabric formed by fusion-bonding of polyester long-filaments, and is capable of retaining the oil at an available oil ratio of not less than 70 mass %.

8. An oil-coating roller according to claim 7, which further comprises an oil-transfer layer provided between the oil-coating control layer and the oil-retaining layer.

* * * * *